US006555282B2

(12) United States Patent
Okuno et al.

(10) Patent No.: US 6,555,282 B2
(45) Date of Patent: Apr. 29, 2003

(54) TONER FOR DEVELOPING ELECTROSTATIC LATENT IMAGE, IMAGE FORMING METHOD AND IMAGE FORMING APPARATUS USING THE SAME

(75) Inventors: Hiroyoshi Okuno, Minamiashigara (JP); Akira Matsumoto, Minamiashigara (JP); Tsutomu Kubo, Minamiashigara (JP); Teigen Lee, Minamiashigara (JP); Yuusaku Shibuya, Minamiashigara (JP); Yutaka Sugizaki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/962,587

(22) Filed: Sep. 26, 2001

(65) Prior Publication Data

US 2002/0061457 A1 May 23, 2002

(30) Foreign Application Priority Data

Sep. 27, 2000 (JP) ..... 2000-293433

(51) Int. Cl.[7] ..... G03G 9/08

(52) U.S. Cl. ..... 430/108.6; 430/108.7; 430/111.4

(58) Field of Search ..... 430/108.6, 108.7, 430/111.4

(56) References Cited

U.S. PATENT DOCUMENTS

| | | | | |
|---|---|---|---|---|
| 5,965,312 A | * | 10/1999 | Nakazawa et al. | 430/106.6 |
| 6,103,441 A | * | 8/2000 | Tomita et al. | 430/110 |
| 6,270,937 B2 | * | 8/2001 | Yuasa et al. | 430/109 |

FOREIGN PATENT DOCUMENTS

| | | |
|---|---|---|
| JP | A 2-1870 | 1/1990 |
| JP | A 2-81053 | 3/1990 |
| JP | A 2-118671 | 5/1990 |
| JP | A 2-118672 | 5/1990 |
| JP | A 2-157766 | 6/1990 |
| JP | A 4-80764 | 3/1992 |
| JP | A 9-288373 | 11/1997 |

* cited by examiner

*Primary Examiner*—John Goodrow
(74) *Attorney, Agent, or Firm*—Oliff & Berridge, PLC

(57) ABSTRACT

A toner for developing an electronic latent image, including toner particles containing a binder resin and a colorant, and an external additive, is provided. The external additive contains silica formed by a sol-gel method of which the surface is subjected to hydrophobic treatment and which has an average primary particle size of 80 to 300 nm, a water content of 3 to 15% and a volume resistivity of $1\times10^{13}$ Ωcm or more. The invention further provides an image forming method and an image forming apparatus using the same. The toner for developing an electrostatic latent image is good in transferability over a long period of time and gives a high image quality without causing an image defect.

16 Claims, 1 Drawing Sheet

TONER FOR DEVELOPING ELECTROSTATIC LATENT IMAGE, IMAGE FORMING METHOD AND IMAGE FORMING APPARATUS USING THE SAME

FIELD OF THE INVENTION

The present invention relates to a toner for developing an electrostatic latent image which is used to develop an electrostatic latent image in an electrophotographic method and an electrostatic recording method, and an image forming method and an image forming apparatus using the same.

DESCRIPTION OF THE RELATED ART

In recent years, PC and networking have been rapidly widespread in offices, and the market of monochromic copying machines and printers which were mainly used in the past is currently being changed to the market of full-color ones. Consequently, the market of electrophotographic copying machines and printing machines which have been so far advantageous in view of an image quality and a speed has been increasingly demanded. Especially, not only a high image quality and high reliability but also downsizing, weight reduction, cost reduction and a high speed as well as the ecological measures such as energy saving, preservation of resources and recycling have been strongly required in the latest market. In order to meet the same, improvements and new developments of an image forming method and a developer used therein have been conducted.

An electrophotographic image forming apparatus (method) generally includes a charging unit (step) of uniformly charging a surface of an electrostatic latent image support, an exposure unit (step) of exposing the surface of the latent image support to form the electrostatic latent image, a developing unit (step) of developing the latent image on the surface of the electrostatic latent image support using a developer layer formed on a surface of a developer support to obtain a toner image, a transfer unit (step) of transferring the toner image on a transfer member, a fixing unit (step) of fixing the toner image on the transfer member, and a cleaning unit (step) of removing the toner remaining on the surface of the electrostatic latent image support in the transfer unit (step). A large number of basic characteristics required of a toner in these units (steps) are an appropriate amount of charge of a toner, charge duration and environmental stability in the developing unit (step), good transferability in the transfer unit (step), low-temperature fixability and offset resistance in the fixing unit (step), and cleaning performance and contamination resistance in the cleaning unit (step). In recent years, owing to the promotion of the high image quality, the high speed and the coloration, the characteristics which are more complicated have been in demand.

For example, in the transfer unit (step), an indirect transfer-type image forming apparatus in which for expediting registration in formation of a color image, toner images on a surface of an electrostatic latent image support are transferred and overlapped in order using an intermediate transfer member and then transferred at once on a transfer member is becoming a mainstream of full-color copying machines and printers in recent years because a higher speed and a higher image quality can be realized. Nevertheless, since the number of transfers of the toner is increased in this indirect transfer-type image forming apparatus, more accurate transferability is required for increasing the image quality, and an additive and a technique of controlling a shape and a surface structure of a toner for providing more stable chargeability and improving transferability have been required of the toner.

Further, with respect to the cleaning unit (step), from not only downsizing and cost reduction of an apparatus but also an ecological standpoint such as energy saving, reservation of resources and reduction of waste, the decrease in amount of a transfer residual toner and reduction in size or elimination (cleaner-less) of a cleaning unit are important subjects. Especially in a full-color image forming apparatus using toners of four colors, yellow, magenta, cyan and black, a transfer residual toner is a serious problem.

In order to avoid the new problems in the transfer and cleaning units (steps), it is important to minimize the amount of the residual toner. To this end, it is necessary to increase transfer efficiency of the toner. For increasing transfer efficiency, it is important to transfer toner particles directly adhered to an electrostatic latent image support, and it is effective to decrease adhesion between the toner and the electrostatic latent image support. With respect to such a method, a method is proposed in which separable fine particles of silica are incorporated in a developer and interposed between a toner and an electrostatic latent image support to decrease adhesion between the toner and the electrostatic latent image support and increase transfer efficiency of the toner as described in, for example, Japanese Patent Laid-Open Nos. 2-1870, 2-81053, 2-118671, 2-118672 and 2-157766. This method improves indeed the transfer efficiency of the toner from the electrostatic latent image support. However, in case of using the intermediate transfer member, no satisfactory transferability can be provided by only decreasing physical adhesion of the toner.

That is, since the toner is transferred with an electrostatic attraction force by applying bias having a reverse polarity to that of the toner to a transfer member, a toner component charged with a reverse polarity or zero-charged cannot be transferred on a transfer member. Further, so-called retransfer occurs in which a toner once transferred in overlapping color images is reversely transferred on an electrostatic latent image support or an intermediate transfer member. Accordingly, in order to maintain high transfer efficiency, it is important to decrease physical adhesion of a toner and to uniformly maintain a toner charge distribution before and after transfer.

As a flowing agent of a toner, hydrophobic silica obtained by a dry method has been so far used. However, since the hydrophobic silica obtained by the dry method has large environmental dependence in charging, a charge distribution tends to be broadened especially at a low temperature and low humidity, and a low-charged toner or a toner charged with a reverse polarity is present in a large amount. Therefore, the transfer deficiency tends to occur. For providing a sharp toner charge distribution, a method in which inorganic fine particles of titanium oxide having relatively low electrical resistance and good charge exchangeability are added to silica particles is known. The use of inorganic fine particles having low electrical resistance provides a narrow charge distribution and decreases an amount of a toner charged with a reverse polarity. However, a toner charge distribution on a transfer member is liable to change by charge injection in a transfer electric field, and the transfer deficiency also tends to occur.

Meanwhile, as another method of improving environmental dependence of the hydrophobic silica obtained by the dry method, a method in which negative silica is mixed with positive silica obtained by positive treatment, and a method in which negative silica is mixed with resin fine particles of PMMA having a positive polarity are proposed. These methods can improve indeed environmental dependence by controlling the increase in charge at a low temperature and low humidity. However, since a charge amount of the toner is decreased as a whole, this method is not satisfactory to improve the transfer deficiency owing to the low-charged toner or the toner charged with a reverse polarity as described above.

Further, as still another method for improving environmental dependence and a charge distribution of silica obtained by a dry method, Japanese Patent Laid-Open No. 4-80,764 proposes that silica obtained by a dry method and having hydrophobic property of 60 to 90% and silica obtained by a wet method and having hydrophobic property of 50 to 80% are used in combination. Compared with silica obtained by a dry method, silica obtained by a wet method has a more porous inner structure and a high adsorbed water content, providing a low level of charge. However, when it is used in combination with silica obtained by a dry method, a toner having a high level of charge and a sharp charge distribution can be obtained. Nevertheless, although silica obtained by a wet method has high apparent hydrophobic property by hydrophobic treatment, electrical resistance is relatively low, and a particle size is large as compared with silica obtained by a dry method. Accordingly, this silica tends to be a charge injection site on a surface of a toner, and the change in charge by a transfer electric field is liable to occur. Especially, silica obtained by decomposing sodium silicate with an acid or an alkali metal salt by a wet method tends to have lower electrical resistance owing to an influence of an alkali ion component remaining therein, and it is difficult to obtain stable transferability.

SUMMARY OF THE INVENTION

The invention has been made in view of these circumstances, and provides a toner for developing an electrostatic latent image, which is good in transferability over a long period of time and gives a high image quality without causing an image defect, and an image forming method and an image forming apparatus using the same.

According to an aspect of the invention, the toner for developing an electrostatic latent image includes toner particles containing a binder resin, a colorant, and an external additive, the external additive containing silica whose surface is treated to be hydrophobic and which has an average primary particle size of 80 to 300 nm, a water content of 3 to 15% and a volume resistivity of $1\times10^{13}$ Ωcm or more.

According to another aspect of the invention, the electrostatic latent image developer includes a carrier and a toner, the toner being the above-described toner.

According to another aspect of the invention, the image forming method includes a charging step of uniformly charging a surface of an electrostatic latent image bearing member, an exposure step of exposing the surface of the electrostatic latent image bearing member to form the electrostatic latent image, a developing step of developing the latent image on the surface of the electrostatic latent image bearing member using a developer layer containing a toner formed on a surface of a developer bearing member to obtain a toner image, a transfer step of transferring the toner image on a transfer member, and a fixing step of fixing the toner image on the transfer member, the toner being the foregoing toner.

According to another aspect of the invention, the image forming apparatus includes a charging unit that uniformly charges a surface of an electrostatic latent image bearing member, an exposure unit that exposes the surface of the electrostatic latent image bearing member to form the electrostatic latent image, a developing unit that develops the latent image on the surface of the electrostatic latent image bearing member using a toner-containing developer layer formed on a surface of a developer bearing member to obtain a toner image, a transfer unit that transfers the toner image on a transfer member, and a fixing unit that fixes the toner image on the transfer member, the toner being the foregoing toner.

BRIEF DESCRIPTION OF THE DRAWING

Preferred embodiments of the invention will be described in detail based on the following figure, wherein.

PREFFERED EMBODIMENTS OF THE INVENTION

Figure 1:
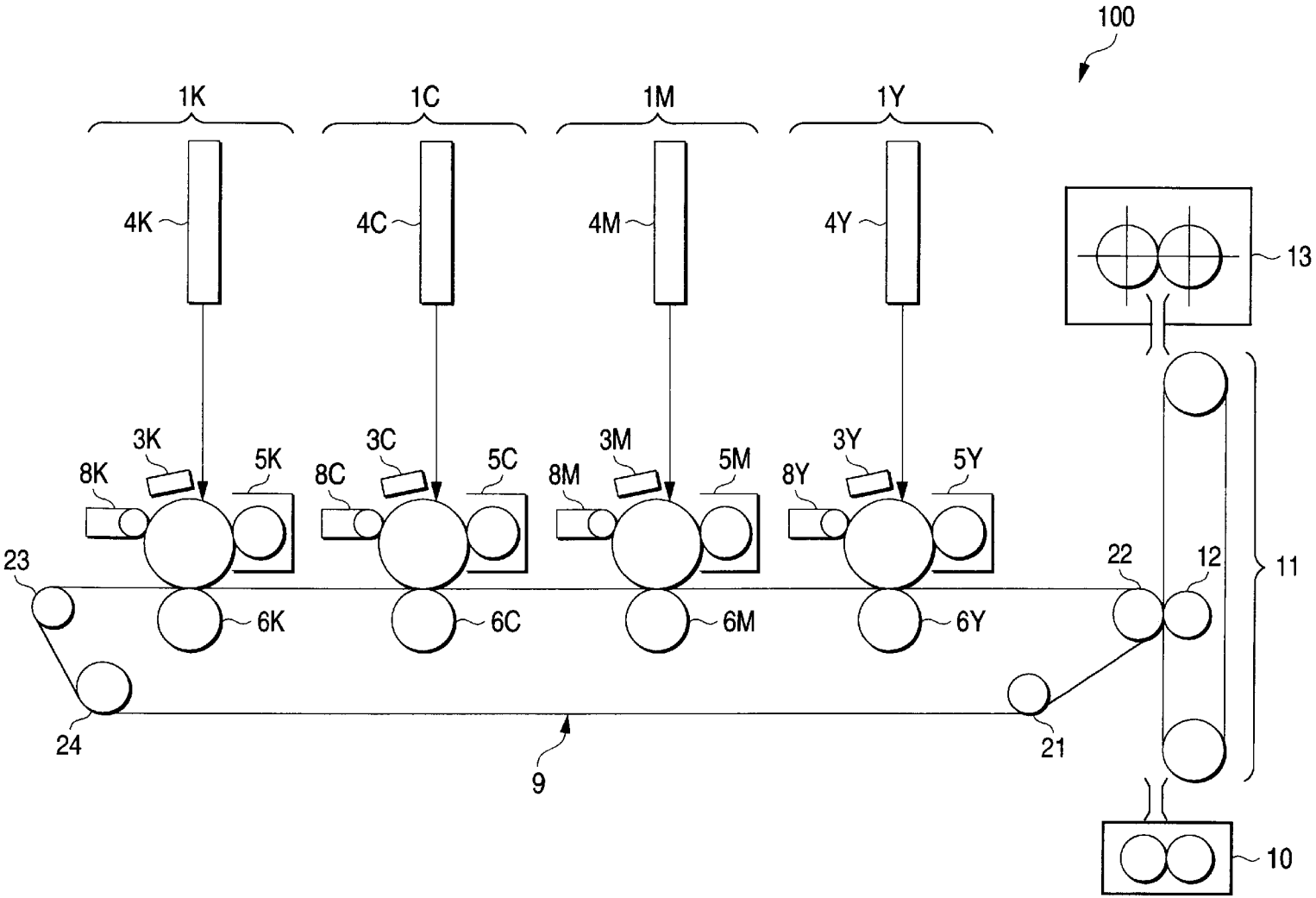
FIG. 1 is a schematic view of an image forming apparatus of tandem electrophotographic processing device which is one embodiment of the image forming method or apparatus of the invention.

The embodiments of the invention are described in detail below.

(Toner for developing an electrostatic latent image)

The toner for developing an electrostatic latent image in the invention includes toner containing a binder resin and a colorant, and an external additive containing silica which is formed by a sol gel method (hereinafter simply referred to as "sol-gel-method silica"), of which the surface is treated to hydrophobic and which has an average primary particle size of 80 to 300 nm, a water content of 3 to 15% and a volume resistivity of $1\times10^{13}$ Ωcm or more. In the toner for developing an electrostatic latent image in the invention, the sol-gel-method silica is used as an external additive along with the toner particles, whereby the toner has good transferability over a long period of time and gives a high image quality without causing an image defect. The reason is uncertain. It is presumed that since the sol-gel-method silica has an appropriate particle size and an appropriate particle size distribution and is high in both the water content and the volume resistivity, physical adhesion of the toner is low, charge injection by a transfer electric field is reduced and a charge distribution is less changed even after plural transfer procedures to be able to maintain good charge and transfer characteristics over a long period of time.

The average primary particle size of the sol-gel-method silica is 80 to 300 nm, preferably 100 to 200 nm. When the average primary particle size is less than 80 nm, silica particles are embedded in the surface of the toner in the repetitive use of a developer, whereby physical adhesion of the toner is increased and no satisfactory transferability is obtained. Further, when the average primary particle size is larger than 300 nm, silica particles are hardly adhered to the surface of the toner, whereby desired chargeability and transferability cannot be imparted to the toner. In addition, silica particles are adhered to a charge member such as an electrostatic latent image support or a carrier to cause filming or charge deterioration.

The water content of the sol-gel-method silica is 3 to 15%, preferably 5 to 10%. When the water content is less than 3%, negative chargeability of silica is increased. Therefore, as is the case with the single use of silica obtained by a dry method, the charge at a low temperature and low humidity is increased and the charge distribution is broadened.

Consequently, an amount of a toner component charged with a reverse polarity or zero-charged is increased to cause fogging or transfer deficiency. Further, when the water content is more than 15%, an amount of charge is extremely decreased, and electrical resistance is also decreased to cause charge and transfer troubles.

The water content here referred to is a value calculated from heating weight loss after heating a product with a thermobalance from room temperature to 15° C. at a rate of rise of 3° C./min and maintaining the same at 150° C. for 30 minutes.

The volume resistivity of the sol-gel-method silica is $1\times10^{13}$ Ωcm or more, preferably $1\times10^{14}$ Ωcm or more. When it is more than $1\times10^{17}$ Ωcm, the sharp charge distribution inherent in the sol-gel-method silica tends to be lost. When the volume resistivity is less than $1\times10^{13}$ Ωcm, it is susceptible to charge injection by a transfer electric field to change a toner charge distribution on an intermediate transfer member and cause transfer deficiency or retransfer.

The volume resistivity here referred to is a value measured by the following method. That is, silica particles are charged on a lower electrode of a measuring unit including a pair of circular electrodes (made of steel) with an area of 20 $cm^2$ connected with an electrometer (KEITHLEY 610C manufactured by Keithley Instruments, Inc.) and a high voltage power supply (FLUKE 415B manufactured by Fluke Corporation) to form a flat layer having a thickness of approximately 1 to 2 mm. Subsequently, an upper electrode is mounted on the silica particles, and a weight of 4 kg is placed on the upper electrode to remove voids in the silica particles. In this state, the thickness of the silica particle layer is measured, and a voltage of 1,000 V is applied to both the electrodes to measure a current value. The volume resistivity is calculated using the formula.

$$\text{Volume resistivity } \rho = V\times S\div(A-A_0)\div d \ (\Omega\text{cm})$$

wherein V is an applied voltage of 1,000 (V), S is an electrode area of 20 ($cm^2$), A is a measured current value (A), $A_0$ is an initial current value (A) when an applied voltage is 0, and d is a thickness (cm) of a fine particle layer.

The sol-gel-method silica is formed as follows. That is, a sol-gel-method silica core having an average primary particle size of 80 to 300 nm is obtained by, according to a known sol gel method, subjecting an alkoxysilane to hydrolysis and condensation in an organic solvent in the presence of water and a catalyst to form a silica sol suspension, removing the solvent and drying and pulverizing the residue. This core is then surface-treated to impart hydrophobic property such that a water content is 3 to 15% and a volume resistivity is $1\times10^{13}$ Ωcm or more.

Specific examples of the alkoxysilane include tetramethoxysilane, tetraethoxysilane, tetraisopropoxysilane and tetrabutoxysilane. Tetramethoxysilane and tetraethoxysilane are preferable in view of the shape, the particle size and the particle size distribution of the resulting silica particles. Examples of the catalyst for expediting the hydrolysis and the condensation of the alkoxysilane include basic catalysts such as ammonia, urea, monoamine and quaternary ammonium salt. Ammonia is preferable. As the organic solvent used in the hydrolysis and the condensation, alcohols having high compatibility with the alkoxysilane, water and the catalyst are preferable. Methanol and ethanol are more preferable.

In the hydrolysis and the condensation, the alkoxysilane is added to the organic solvent in the presence of water and the catalyst, and the mixture is stirred at, preferably 0 to 100° C. to form a silica sol suspension. At this time, since the amounts of water and the catalyst and the type and the amount of the alkoxysilane influence the particle size, the particle size distribution and the specific gravity of the resulting particles, they are property adjusted and selected such that these properties are in desirable ranges. When the solvent is removed from the silica sol suspension and the residue is pulverized to obtain the sol-gel-method silica core, a method is used in which the suspension is filtered and then centrifuged, the solvent is evaporated, and the residue is dried and pulverized.

Subsequently, the resulting sol-gel-method silica core is used by subjecting the surface to hydrophobic treatment such that the water content is 3 to 15% and the volume resistivity is $1\times10^{13}$ Ωcm or more. As a hydrophobic agent, a silane coupling agent is preferably used. A silane having a dimethyl or trimethyl group is preferable. A general hydrophobic agent of silica, for example, dimethyl silicone oil or a silane having a long-chain alkyl group, such as isobutyltrialkoxysilane or decyltrialkoxysilane, can be reacted with a silanol group present on a polar surface of silica but cannot be satisfactorily reacted with a surface silanol group present in fine pores in an inner structure of the sol-gel-method silica due to a molecular structure. Thus, the volume resistivity cannot be increased satisfactorily, though the water content of silica particles can be increased.

A method of hydrophobic treatment may be any method so long as the water content of silica is 3 to 15% and the volume resistivity is $1\times10^{13}$ Ωcm or more. It is preferable that the temperature in the treatment is maintained at 200° C. or less. A liquid-phase treatment method is preferable in which the silane coupling agent is dissolved in an appropriate organic solvent and reacted with silica particles at a temperature of 80 to 150° C. and the solvent is then removed. As a general method of hydrophobic treatment, there is a method of gaseous-phase treatment in which, for example, silica particles and a silane coupling agent are fed to a fluidized bed heated along with water vapor by an inert gas such as a nitrogen gas for reaction. In this method, since silica particles are heated at a high temperature of 400° C. or more, silanol groups present in surfaces and inner pores of silica particles are eliminated by condensation. Water adsorbed to silanol groups with Van der Vaals force is therefore also lost. As a result, the volume resistivity can be increased to $1\times10^{15}$ Ωcm or more, but chargeability inherent in the sol-gel-method silica is not provided.

As the method of hydrophobic treatment, a method in which a silica sol suspension is filtered and centrifuged, a solvent is evaporated, the residue is dried and pulverized and the particles are subjected to hydrophobic treatment is available. Especially, in order to make the volume resistivity $1\times10^{15}$ Ωcm or more, a large amount of an agent and much time are required in the treatment. Accordingly, for reacting the agent with a silanol group in an inner structure of silica efficiently, a method is preferable in which a hydrophobic agent is added to a silica sol suspension to conduct hydrophobic treatment, then the solvent is removed and the residue is dried. In this case, for expediting the reaction of the agent with silica, it is also possible that water and alcohol in the silica sol suspension are replaced with an appropriate solvent, and the agent is then added to conduct hydrophobic treatment. It is further preferable that the hydrophobic agent is added to the silica sol suspension to conduct hydrophobic treatment, the solvent is then removed, the residue is dried and the resulting silica particles are further subjected to hydrophobic treatment, because the volume resistivity is increased enough. For expediting the reaction of the agent with the silanol group on the surface of silica, a method in which water adsorbed on the surface of silica is temporarily removed and the product is then treated is more preferable. Specifically, a method in which the agent and the silica sol suspension are retained at a temperature of 110 to 150° C. for treatment is advantageous.

It is advisable, in view of chargeability, that in the toner for developing an electrostatic latent image in the invention, silica obtained by a dry method (hereinafter simply referred to as a "dry-method silica") and subjected to hydrophobic treatment is used as an external additive along with the sol-gel-method silica. The combined use of the sol-gel-method silica having the sharp charge distribution and the dry-method silica having high negative chargeability can provide a toner having an appropriate charge amount and a sharp charge distribution. Consequently, charge injection by a transfer electric field is effectively reduced, and the charge distribution is less changed even after plural transfer procedures. Thus, good charge and transfer characteristics can be maintained.

The average primary particle size of the dry-method silica is preferably 20 to 200 nm, more preferably 30 to 120 nm. When the average primary particle size is less than 20 nm, there is a possibility that silica particles are embedded in the surface of the toner in the repetitive use of a developer to increase physical adhesion of the toner and satisfactory transferability is not obtained. Further, fluidity of the toner tends to decrease to cause soft blocking. Moreover, when it exceeds 200 nm, satisfactory fluidity sometimes cannot be imparted to the toner.

The volume resistivity of the dry-method silica is preferably $1\times10^{16}$ Ωcm or more. When the volume resistivity is less than $1\times10^{16}$ Ωcm, there is a possibility that satisfactory negative chargeability is not imparted to the toner and it is susceptible to charge injection by a transfer electric field to decrease transferability. Incidentally, this volume resistivity is a value measured as in the sol-gel method silica.

The surface of the dry-method silica is subjected to hydrophobic treatment. As the hydrophobic agent, known agents such as a silane compound and silicone oil are used. As the method of hydrophobic treatment, a known method such as a gaseous-phase method or a liquid-phase method is available.

In the toner for developing an electrostatic latent image in the invention, the amount of the sol-gel-method silica is preferably 0.3 to 3.0% by weight, more preferably 0.5 to 2.5% by weight based on the toner particles. Meanwhile, the amount of the dry-method silica is preferably 0.1 to 2.0% by weight, more preferably 0.2 to 1.5% by weight based on the toner particles. Further, the ratio of sol-gel-method silica dry-method silica is preferably 1:2 to 2:1. When the ratio is outside this range, the desired charge level and charge distribution sometimes cannot be provided.

The toner for developing an electrostatic latent image in the invention may contain, in addition to the sol-gel-method silica, inorganic fine particles as an external additive for imparting fluidity and controlling charge. It is also possible to add, as required, inorganic fine particles and resin fine particles as an abrasive and a cleaning aid. Of these external additives, titanium oxide fine particles treated to hydrophobic and having an average primary particle size of 10 to 50 nm are preferably used because an environmental difference in charging a toner can be reduced. In this case, the volume resistivity of the titanium oxide fine particles is preferably $1\times10^{10}$ Ωcm to $1\times10^{14}$ Ωcm. When the volume resistivity of the titanium oxide fine particles is less than $1\times10^{10}$ Ωcm, charge injection by a transfer electric field tends to occur. Meanwhile, when it is more than $1\times10^{14}$ Ωcm, an effect of minimizing an environmental difference in charging a toner is sometimes eliminated. Further, when the average primary particle size of the titanium oxide fine particles exceeds 50 nm, charge injection tends to occur. Moreover, when it is less than 10 nm, dispersion in the toner is liable to be insufficient.

In the toner for developing an electrostatic latent image in the invention, the addition of the external additives such as the sol-gel-method silica and the like to the toner particles can be conducted using a mixer such as an ordinary V-type blender or a Henschel mixer.

In the toner for developing an electrostatic latent image, the toner particles are not particularly limited, and it contains at least a binder resin and a colorant and, as required, other components.

Examples of the binder resin include known materials such as polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, a polyester, a polyurethane, an epoxy resin, a silicone resin, a polyamide, a modified rosin and paraffin wax. Of these, a styrene-acrylic copolymer and a polyester are preferable.

As the colorant, known organic or inorganic pigments may be used. Specific examples thereof include inorganic pigments, for example, carbon blacks such as furnace black, channel black, acetylene black and thermal black, iron red oxide, ultramarine blue and titanium oxide; azo pigments such as Fast Yellow, disazo yellow, pyrazolone red, chelate red, Brilliant Carmin and Para Brown; phthalocyanine pigments such as copper phthalocyanine and nonmetallic phthalocyanine; and polycyclic pigments such as flavanthrone yellow, dibromoanthrone orange, perylene red, quinacridone red and dioxazine violet. By the way, the toner for developing an electrostatic latent image in the invention can be used as a magnetic monocomponent toner by replacing the whole or a part of a black colorant with a magnetic powder. Examples of the magnetic powder can include magnetite, ferrite, a single metal such as cobalt, iron or nickel and an alloy thereof. The amount of the colorant is preferably 1 to 50 parts by weight, more preferably 2 to 20 parts by weight per 100 parts by weight of the binder resin.

It is advisable that the toner particles contain wax as the other component because oil supply to a fixing unit is dispensed with and a space is saved. Specific examples of wax include petroleum waxes such as paraffin wax, oxidized paraffin wax and microcrystalline wax; mineral waxes such as montan wax; animal and plant waxes such as beeswax and carnauba wax; and synthetic waxes such as polyolefin wax, oxidized polyolefin wax and Fischer-Tropsch wax. These can be used either singly or in combination. The melting point of wax is preferably 40 to 150° C., more preferably 50 to 120° C.

The toner particles may contain a charge control agent as the other component, and those ordinarily used in a developer are available. Preferable examples thereof include those used in a toner powder for xerography, such as a benzoic acid metal salt, a salicylic acid metal salt, an alkylsalicylic acid metal salt, a cathecol metal salt, a metal-containing bisazo dye, tetraphenyl borate derivatives, a quaternary ammonium salt and an alkyl pyridinium salt, and a polar group-containing resin-type charge control agent. They can be used either singly or in combination. The amount of the charge control agent is preferably 10% by weight or less based on the solid content of the toner.

The sphericity $ML^2/A$ of the toner particles is preferably 100 to 135, more preferably 100 to 125. When $ML^2/A$ is more than 135, the physical adhesion of the toner cannot satisfactorily be decreased even using the silica particles of the invention and transfer efficiency is decreased. Further, the average particle size of the toner particles is preferably at least 3 $\mu$m and at most 10 $\mu$m.

The sphericity here referred to is a value calculated from the formula $$\text{Sphericity}=100\times\pi\times ML^2/(4\times A)$$

wherein ML is a maximum length of toner particles calculated from a two-dimensional project image of the particles inputted from an optical microscope by an image analyzer, and A is a project area of toner particles.

Examples of a method of producing toner particles include a kneading-pulverization method in which the binder resin, the colorant and, as required, other components such as wax and the like are kneaded, pulverized and classified, a method in which the toner obtained by the kneading-pulverization method is formed into spheres through heat treatment, a submerged drying method in which an oil component dissolved and dispersed in an organic solvent is suspended in an aqueous medium and the solvent is then removed, a melt-suspension method in which toner materials are kneaded and the kneaded product heat-dissolved in an immiscible medium is pulverized, an emulsion polymerization-agglomeration method in which a polymerizable monomer of a binder resin is emulsion-polymerized, the resulting dispersion is mixed with a dispersion of a colorant and, as required, other components such as wax and the like, and the mixture is agglomerated and heat-fused to obtain toner particles, and a suspension polymerization method in which a polymerizable monomer of a binder resin and a solution of a colorant and, as required, other components such as wax and the like are suspended in an aqueous solvent and polymerized.

The toner for developing an electrostatic latent image in the invention, like ordinary toners, can be converted into a toner for developing an electrostatic latent image suitable as a two-component developer by being used in combination with a carrier. As the carrier, an iron powder, glass beads, a ferrite powder, a nickel powder, a magnetite powder, a carrier obtained by coating a resin on surfaces of these and a resin dispersion carrier obtained by kneading a resin with a charge control agent and a magnetic material, pulverizing the mixture and classifying the particles can be used. The carrier with a resin coated layer obtained by coating a resin on surfaces of inorganic particles is especially preferable.

(Image forming method and image forming apparatus)

The image forming method of the invention is described below. The image forming apparatus is also described with the image forming method.

The image forming method (apparatus) of the invention includes a charging step (unit) of uniformly charging a surface of an electrostatic latent image support, an exposure step (unit) of exposing the surface of the electrostatic latent image support to form the electrostatic latent image, a developing step (unit) of developing the latent image on the surface of the electrostatic latent image support using a toner-containing developer layer formed on a surface of a developer support to obtain a toner image, a transfer step (unit) of transferring the toner image on a transfer member, and a fixing step (unit) of fixing the toner image on the transfer member, in which the toner for developing an electrostatic latent image of the invention is used as the toner. Since the image forming method (apparatus) of the invention uses the toner for developing an electrostatic latent image in the invention, it is possible to provide good transferability over a long period of time, give a high image quality and inhibit occurrence of an image defect.

Since the image forming method (apparatus) of the invention uses the toner for developing an electrostatic latent image in the invention, it can also be applied to an image forming method (apparatus) free from a cleaning step (unit) in which a toner remaining on a surface of an electrostatic latent image support is removed by contact with an elastic blade while rubbing the surface of the electrostatic latent image support.

In the electrostatic latent image support, a known material such as an organic material or amorphous silicon can be used as a photosensitive layer. When the electrostatic latent image support has a cylindrical shape, it can be obtained by a known method in which aluminum, an aluminum alloy or SUS is extrusion-molded and surface-processed. In view of downsizing and cost reduction of an apparatus in recent years, a product having a small diameter of 50 mm or less is preferably used. Further, a belt-like electrostatic latent image support is also available.

In the charging step (unit), a known method such as non-contact charging with a corotron or contact charging with a charging roll, a charging film or a brush is available. In view of an amount of ozone generated, a contact charger is preferably used.

In the exposure step (unit), a known method can be used, and an electrostatic latent image is formed on a latent image support such as a photosensitive layer or a dielectric layer by an electrophotographic method or an electrostatic recording method.

In the developing step (unit), a toner-containing developer layer formed on the surface of the developer support is transported to a developing nip. The developer layer and the electrophotographic latent image support are contacted or mounted at a fixed interval in a developing section. While bias is applied between the developer support and the latent image support, the electrostatic latent image is developed with the toner. As the developer, a two-component developer that charges a toner with a carrier or a single component developer in which a thin film of a toner is formed on the developer support using an elastic blade and charged is used.

In the transfer step (unit), contact transfer in which a transfer roll or a transfer belt is urged against the electrostatic latent image support to transfer the toner image on a transfer member or non-contact transfer in which a toner image is transferred on a transfer member with a corotron is used. It is especially preferable that the transfer step (unit) includes a first transfer step (unit) of primarily transferring the toner image formed on the electrostatic latent image support on an intermediate transfer member, and a second transfer step (unit) of secondarily transferring the toner image transferred on the intermediate transfer member on a transfer member. Specifically, in a full-color image forming apparatus, a method in which yellow, magenta, cyan and black toners are directly transferred on a transfer member (for example, paper) using a transfer roll or a transport belt having the transfer member wound thereon is available. An indirect transfer method in which toners of four colors are subjected to multi-layer transfer (primary transfer) on the intermediate transfer member and then transferred (secondary transfer) on the transfer member is especially preferable. As the intermediate transfer member, a belt or a cylindrical member is available, and a known member can be used.

In the fixing step (unit), the toner image transferred on the transfer member is fixed with a fixing unit. As the fixing unit, a heat-fixing system using a heating roll is preferably used.

FIG. 1 is a schematic view of an apparatus of tandem engine preferably used in the image forming method (apparatus) of the invention. An image forming apparatus 100 includes an image forming unit 1Y, an image forming unit 1M, an image forming unit 1C, an image forming unit 1K, an intermediate transfer member 9, a sheet feeding unit 10, a transport unit 11, a transfer unit 12 for secondary transfer, a fixing unit 13 and tension rolls 21 to 24. The image forming unit 1Y, the image forming unit 1M, the image forming unit 1C and the image forming unit 1K are units of an image forming apparatus for forming toner images of yellow, magenta, cyan and black colors. The image forming unit 1Y, the image forming unit 1M, the image forming unit 1C and the image forming unit 1K are mounted in this order in series in the advance direction of the endless intermediate transfer member 9 tensioned on the tension rolls 21 to 24. The intermediate transfer member 9 is passed between an electrostatic latent image support 2Y, an electrostatic latent image support 2M, an electrostatic latent image support 2C and an electrostatic latent image support 2K mounted on the respective image forming units on the one hand and a transfer unit 6Y, a transfer unit 6M, a transfer unit 6C and a transfer unit 6K mounted opposite thereto on the other.

The image forming unit 1Y, the image forming unit 1M, the image forming unit 1C and the image forming unit 1K have electrostatic latent image supports 2Y, 2M, 2C, 2K, charging units 3Y, 3M, 3C, 3K, exposure units 4Y, 4M, 4C, 4K, developing units 5Y, 5M, 5C, 5K, and charge-removal units 8Y, 8M, 8C, 8K. Electrostatic latent images are formed on the electrostatic latent image supports 2Y, 2M, 2C, 2K with the charging units 3Y, 3M, 3C, 3K and the exposure units 4Y, 4M, 4C, 4K respectively. The electrostatic latent images become toner images by the developing units 5Y, 5M, 5C, 5K. The toner images are transferred on the intermediate transfer member 9 with the transfer units 6Y, 6M, 6C, 6K. After the transfer, the toners remaining on the surfaces of the electrostatic latent image supports are erased with the charge-removal units 8Y, 8M, 8C, 8K. Toner images of yellow, magenta, cyan and black colors are formed with the image forming unit 1Y, the image forming unit 1M, the image forming unit 1C and the image forming unit 1K, and the toner images of the respective colors formed are subjected to multi-layer transfer on the intermediate transfer member 9 advancing from the image forming unit 1Y to the image forming unit 1K to form the images. Further, the toner images on the intermediate transfer member 9 are transferred on the transfer member such as paper by the transfer unit 12 for secondary transfer, and fixed with the fixing unit 13. In this manner, the images are formed.

EXAMPLES

The invention is illustrated specifically by referring to the following Examples and Comparative Examples. However, the invention is not limited at all to these Examples.

Silica Synthesis Example 1

A glass reactor is fitted with a stirrer, a dropping funnel and a thermometer. Aqueous ammonia is added to ethanol, and the solution is stirred, and maintained at 20° C. Subsequently, tetraethoxysilane is added dropwise to this solution for 60 minutes for reaction. After the completion of the dropwise addition, the mixture is further stirred at 20° C. for 5 hours to obtain a silica sol suspension. The silica sol suspension is then heated to remove ethanol, and toluene is added. The mixture is further heated to remove water. Then, 40% hexamethyldisilazane is added to the silica particles of the suspension, and the mixture is reacted at 120° C. for 2 hours to conduct hydrophobic treatment of silica. Thereafter, the suspension is heated to remove toluene, and the residue is dried. Coarse particles are then removed using a sieve having an opening of 106 $\mu$m to obtain sol-gel-method silica A having an average primary particle size of 120 nm. The water content of this silica is measured, and found to be 7.8% by weight. Further, the volume resistivity is measured, and found to be $2\times10^{15}$ Ωcm.

Silica Synthesis Example 2

Sol-gel-method silica A in Synthesis Example 1 is dissolved in toluene, and 20% hexamethyldisilazane is added to the silica particles. The mixture is stirred at 120° C. for 1 hour, and further subjected to hydrophobic treatment. Then, the suspension is heated to remove toluene. The residue is dried, and coarse particles are then removed with a sieve having an opening of 106 $\mu$m to obtain sol-gel-method silica B having an average primary particle size of 120 nm. The water content of this silica is measured, and found to be 6.5% by weight. Further, the volume resistivity is measured, and found to be $1\times10^{16}$ Ωcm.

Silica Synthesis Example 3

The silica sol suspension in Synthesis Example 1 is heated before hydrophobic treatment, and is dried to obtain silica particles. The silica particles are dissolved in toluene, and 10% hexamethyldisilazane is added to the silica particles. The mixture is stirred at 120° C. for 1 hour to conduct hydrophobic treatment. Then, the reaction mixture is heated to remove toluene. The residue is dried, and coarse particles are then removed with a sieve having an opening of 106 $\mu$m to obtain sol-gel-method silica C having an average primary particle size of 115 nm. The water content of this silica is measured, and found to be 8.8% by weight. Further, the volume resistivity is measured, and found to be $3\times10^{12}$ Ωcm.

Silica Synthesis Example 4

The silica sol suspension in Synthesis Example 1 is heated before hydrophobic treatment, and is dried to obtain silica particles. To the silica particles is added 10% hexamethyldisilazane in a fluidized bed heated at 500° C. to conduct hydrophobic treatment. Coarse particles are removed with a sieve having an opening of 106 $\mu$m to obtain sol-gel-method silica D having an average primary particle size of 118 nm. The water content of this silica is measured, and found to be 2.2% by weight. Further, the volume resistivity is measured, and found to be $6\times10^{16}$ Ωcm.

Silica Synthesis Example 5

Sol-gel-method silica E having an average primary particle size of 118 nm is obtained as in Synthesis Example 1 except that the temperature and the time of the hydrophobic treatment of silica are changed to 150° C. and 3 hours. The water content of this silica is measured, and found to be 3.7% by weight. Further, the volume resistivity is measured, and found to be $1.8\times10^{16}$ Ωcm.

Silica Synthesis Example 6

A silica sol suspension different from that in Synthesis Example 1 is obtained by changing the amount of tetraethoxysilane added to ethanol and the stirring rate of the silica sol suspension. Subsequently, the silica sol suspension is heated to remove ethanol, and toluene is then added. The mixture is further heated to remove water. Thereafter, 40% hexamethyldisilazane is added to the silica particles of the suspension, and the mixture is then reacted at 120° C. for 2 hours to conduct hydrophobic treatment of silica. The suspension is then heated to remove toluene. The residue is dried, and coarse particles are then removed with a sieve having an opening of 106 μm to obtain sol-gel-method silica F having an average primary particle size of 83 nm. The water content of this silica is measured, and found to be 14.2% by weight. Further, the volume resistivity is measured, and found to be $2\times10^{13}$ Ωcm.

Silica Synthesis Example 7

Sol-gel-method silica G having an average primary particle size of 81 nm is obtained as in Synthesis Example 6 except that the amount of hexamethyldisilazane is changed to 20% in Synthesis Example 6. The water content of this silica is measured, and found to be 15.8% by weight. Further, the volume resistivity is measured, and found to be $8\times10^{12}$ Ωcm.

Silica Synthesis Example 8

A silica sol suspension different from those in Synthesis Examples 1 and 6 is obtained by changing the amount of tetraethoxysilane added to ethanol and the stirring rate of the silica sol suspension as in Synthesis Example 6. Subsequently, this silica sol suspension is heated to remove ethanol, and toluene is then added. The mixture is further heated to remove water. Thereafter, 40% hexamethyldisilazane is added to the silica particles of the suspension, and the mixture is reacted at 120° C. for 2 hours to conduct hydrophobic treatment of silica. The suspension is then heated to remove toluene. The residue is dried, and coarse particles are then removed with a sieve having an opening of 106 μm to obtain sol-gel-method silica H having an average primary particle size of 76 nm. The water content of this silica is measured, and found to be 14.8% by weight. Further, the volume resistivity is measured, and found to be $1\times10^{13}$ Ωcm.

Silica Synthesis Example 9

A silica sol suspension different from those in Synthesis Examples 1, 6 and 8 is obtained by changing the amount of tetraethoxysilane added to ethanol and the stirring rate of the silica sol suspension as in Synthesis Example 6. Subsequently, this silica sol suspension is heated to remove ethanol, and toluene is then added. The mixture is further heated to remove water. Thereafter, 40% hexamethyldisilazane is added to the silica particles of the suspension, and the mixture is reacted at 120° C. for 2 hours to conduct hydrophobic treatment of silica. The suspension is then heated to remove toluene. The residue is dried, and coarse particles are then removed with a sieve having an opening of 106 μm to obtain sol-gel-method silica I having an average primary particle size of 250 nm. The water content of this silica is measured, and found to be 3.3% by weight. Further, the volume resistivity is measured, and found to be $7\times10^{15}$ Ωcm.

Silica Synthesis Example 10

A silica sol suspension different from those in Synthesis Examples 1, 6, 8 and 9 is obtained by changing the amount of tetraethoxysilane added to ethanol and the stirring rate of the silica sol suspension as in Synthesis Example 6. Subsequently, this silica sol suspension is heated to remove ethanol, and toluene is then added. The mixture is further heated to remove water. Thereafter, 40% hexamethyldisilazane is added to the silica particles of the suspension, and the mixture is reacted at 120° C. for 2 hours to conduct hydrophobic treatment of silica. The suspension is then heated to remove toluene. The residue is dried, and coarse particles are then removed with a sieve having an opening of 106 μm to obtain sol-gel-method silica J having an average primary particle size of 320 nm. The water content of this silica is measured, and found to be 2.9% by weight. Further, the volume resistivity is measured, and found to be $9\times10^{15}$ Ωcm.

[Production of toner particles]

(Production of cyan toner particles C)

Resin dispersion 100 parts (styrene-butyl acrylate-acrylic acid copolymer, copolymerization ratio 82:18:2, Mw=23,000, Tg=65° C.)

Pigment dispersion (C. I. pigment blue) 12 parts

Cationic surfactant (SANISOL C made by Kao Corporation) 0.6 part

These components are mixed and dispersed with Ultrataxlax T50 (manufactured by IKA) in a stainless steel round flask. Then, the flask is heated in a heating oil bath to 50° C. while stirring the dispersion. After the reaction mixture is maintained at 50° C. for 60 minutes, the particle size is measured. Consequently, it is identified that an agglomerate having a particle size of 4.5 μm is formed. The temperature of the heating oil bath is elevated, and the flask is retained at 52° C. for 1 hour. The particle size is measured, and it is identified that an agglomerate having a particle size of 5.0 μm is formed. Subsequently, 1 part of an anionic surfactant (Neogen RK made by Dai-ichi Kogyo Seiyaku Co., Ltd.) is added to the suspension containing the agglomerate, and the stainless steel flask is then closed. While the stirring is continued using a magnetic seal, the mixture is heated to 97° C., and maintained for 4 hours. After the cooling, the particle size is measured, and found to be 6.1 μm. The toner particles are separated from the solution containing the toner particles by filtration, and washed with deionized water three times. Subsequently, the toner particles are dispersed in 5 liters of deionized water, and adjusted to pH of 9.5 with 1 N sodium hydroxide. The dispersion is moved again to the round stainless steel flask which is then heated in a heating oil bath to 80° C. while stirring the mixture. The reaction mixture is maintained for 2 hours. Then, the toner particles are separated by filtration, washed with deionized water three times, vacuum-dried for 10 hours, and sieved to obtain cyan toner particles C having an average particle size of 6.2 μm and sphericity of 115.

(Production of magenta toner particles M)

Magenta toner particles M having D50 of 6.4 μm and sphericity of 118 are obtained in the same manner as cyan toner particles C except that the pigment is changed to 5 parts of C. I. pigment red 57:1.

(Production of yellow toner particles Y)

Yellow toner particles Y having D50 of 6.6 μm and sphericity of 116 are obtained in the same manner as cyan toner particles C except that the pigment is changed to 10 parts of C. I. pigment yellow 180.

(Production of black toner particles K)

Black toner particles K having D50 of 6.5 μm and sphericity of 111 are obtained in the same manner as cyan toner particles C except that the pigment is changed to 4 parts of carbon black.

(Production of a carrier)

Three parts of polymethyl methacrylate are coated on 100 parts of a carrier core F35 (Cu—Zn ferrite made by Powder Tec) with a pressure kneader, and sieved to obtain resin-coated carrier X having a size of 35 $\mu$m.

Example 1

One hundred parts of each of toner particles C, M, Y and K are mixed with 1.5 parts by weight of sol-gel-method silica A, 1.2 parts by weight of dry-method silica of which the surface is subjected to hydrophobic treatment with hexamethyldisilazane and which has an average primary particle size of 40 nm and further 1.0 part by weight of rutile titanium oxide surface-treated with hexamethyldisilazane and having an average primary particle size of 20 nm and a volume resistivity of $2\times10^{13}$ Ωcm using a Henschel mixer to produce a toner.

The resulting toner is mixed with resin-coated carrier X to obtain a developer.

The resulting toner and developer are subjected to a test of printing 100,000 sheets with an image forming apparatus shown in FIG. 1, and an image quality and transferability are evaluated. Consequently, the good results that transfer deficiency and retransfer do not occur and fogging and uneven density are reduced are obtained.

[Evaluation of transferability]

(1) Primary transfer efficiency (%)=(weight of a toner transferred on an intermediate transfer member)/(weight of a toner transferred on an intermediate transfer member+ weight of an untransferred toner on a photosensitive drum)× 100

(2) Secondary transfer efficiency (%)=(weight of a toner transferred on transfer sheet)/(weight of a toner transferred on transfer sheet+weight of an untransferred toner on an intermediate transfer member)×100

(OO . . . 99% or more O . . . 98% or more Δ . . . 95% or more x . . . less than 95%)

Example 2

A toner and a developer are obtained in exactly the same manner as in Example 1 except that sol-gel-method silica A is replaced with sol-gel-method silica B. The toner and the developer are evaluated as in Example 1. Consequently, the good results that transfer deficiency and retransfer do not occur and fogging and uneven density are reduced are obtained.

Comparative Example 1

A toner and a developer are obtained in exactly the same manner as in Example 1 except that sol-gel-method silica A is not added. The toner and the developer are subjected to the same printing test as in Example 1. Consequently, transfer deficiency and uneven density occur from the initial stage.

Comparative Example 2

A toner and a developer are obtained in exactly the same manner as in Example 1 except that sol-gel-method silica A is replaced with sol-gel method silica C. The toner and the developer are subjected to the same printing test as in Example 1. Consequently, secondary transfer deficiency deemed to be ascribable to the decrease in charge of the toner on the intermediate transfer member occurs at a high temperature and high humidity.

Comparative Example 3

A toner and a developer are obtained in exactly the same manner as in Example 1 except that sol-gel-method silica A is replaced with sol-gel method silica D. The toner and the developer are subjected to the same printing test as in Example 1. Consequently, the decrease in density owing to the increase in charge is observed at a low temperature and low humidity, and fogging and transfer deficiency deemed to be ascribable to the broadening of the charge distribution occur.

Example 3

A toner and a developer are obtained in exactly the same manner as in Example 1 except that sol-gel-method silica A is replaced with sol-gel method silica E. The toner and the developer are evaluated as in Example 1. Consequently, the good results that transfer deficiency and retransfer do not occur and fogging and uneven density are reduced are obtained.

Example 4

A toner and a developer are obtained in exactly the same manner as in Example 1 except that sol-gel-method silica A is replaced with sol-gel method silica F. The toner and the developer are evaluated as in Example 1. Consequently, after 50,000 sheets are printed, fogging slightly occurs and transferability is slightly decreased, but the relatively good results are obtained.

Comparative Example 4

A toner and a developer are obtained in exactly the same manner as in Example 1 except that sol-gel-method silica A is replaced with sol-gel method silica G. The toner and the developer are subjected to the same printing test as in Example 1. Consequently, fogging and transfer deficiency occur at a high temperature and high humidity owing to low charge.

Comparative Example 5

A toner and a developer are obtained in exactly the same manner as in Example 1 except that sol-gel-method silica A is replaced with sol-gel-method silica H. The toner and the developer are subjected to the same printing test as in Example 1. Consequently, after 3,000 sheets are printed, transfer deficiency occurs.

Example 5

A toner and a developer are obtained in exactly the same manner as in Example 1 except that sol-gel-method silica A is replaced with sol-gel-method silica I. The toner and the developer are subjected to the same printing test as in Example 1. Consequently, after 70,000 sheets are printed, a photoreceptor begins silica filming slightly. However, the relatively good results that transfer deficiency and retransfer do not occur and fogging and uneven density are reduced are obtained.

Comparative Example 6

A toner and a developer are obtained in exactly the same manner as in Example 1 except that sol-gel-method silica A is replaced with sol-gel-method silica J. The toner and the developer are subjected to the same printing test as in Example 1. Consequently, after 4,000 sheets are printed, silica filming occurs on a photoreceptor, and an image defect occurs.

TABLE 1

| | Sol-gel-method silica | Dry-method silica | Image density | Fogging | Transferability primary | Transferability secondary | Filming | Total evaluation |
|---|---|---|---|---|---|---|---|---|
| Ex. 1 | A 1.5 parts by weight | 1.2 parts by weight | A | A | S | A | A | A |
| Ex. 2 | B 1.5 parts by weight | 1.2 parts by weight | A | A | S | S | A | S |
| Ex. 3 | E 1.5 parts by weight | 1.2 parts by weight | A | A | S | S | A | S |
| Ex. 4 | F 1.5 parts by weight | 1.2 parts by weight | A | B | B | A | A | B-A |
| Ex. 5 | I 1.5 parts by weight | 1.2 parts by weight | A | A | A | A | B | B-A |
| Comp. Ex. 1 | — | 1.2 parts by weight | B | B | C | C | A | C |
| Comp. Ex. 2 | C 1.5 parts by weight | 1.2 parts by weight | B | A | A | C | A | C |
| Comp. Ex. 3 | D 1.5 parts by weight | 1.2 parts by weight | C | C | B | B | A | C |
| Comp. Ex. 4 | G 1.5 parts by weight | 1.2 parts by weight | B | C | C | C | A | C |
| Comp. Ex. 5 | H 1.5 parts by weight | 1.2 parts by weight | A | A | C | C | A | C |
| Comp. Ex. 6 | J 1.5 parts by weight | 1.2 parts by weight | B | A | A | A | C | C |

<Total evaluation>

<Total evaluation >

S—especially good

A—good

B—slightly bad

C—bad

<Image density>

Density of a solid area is measured with a densitometer X-Rite 404A manufactured by X-Rite Incorporated, and evaluated with the following grades.

A—1.3 or more

B—1.1 or more

C—less than 1.1

<Fogging>

A sheet for an image background area is observed with a 50×magnifier, and fogging is evaluated with the following grades.

A—no fogging

B—slight fogging

C—heavy fogging

Effects of the Invention

As has been thus far described, the invention can provide a toner for developing an electrostatic latent image, which is good in transferability over a long period of time and gives a high image quality without causing an image defect, and an image forming method and an image forming apparatus using the same.

The entire disclosure of Japanese Patent Application No. 2000-293433 filed on Sep. 27, 2000 including specification, claims, drawings and abstract is incorporated herein by reference in its entirety.

What is claimed is:

1. A toner for developing an electrostatic latent image, comprising a toner particle containing a binder resin, a colorant and an external additive, the external additive containing a silica formed by a sol-gel method, whose surface is treated to be hydrophobic and which has an average primary particle size of 80 to 300 nm, and which has a water content of 3 to 15% and a volume resistivity of $1\times10^{13}$ Ωcm or more.

2. The toner for developing an electrostatic latent image as claimed in claim 1, wherein the volume resistivity of the silica is not less than $1\times10^{14}$ Ωcm and not more than $1\times10^{17}$ Ωcm.

3. The toner for developing an electrostatic latent image as claimed in claim 1, wherein the amount of the silica is 0.3 to 3.0% by weight based on the toner particle.

4. The toner for developing an electrostatic latent image as claimed in claim 1, wherein the external additive further contains a silica having a water content of less than 1%.

5. The toner for developing an electrostatic latent image as claimed in claim 4, wherein the silica having the water content of less than 1% has an average primary particle size of 20 to 100 nm.

6. The toner for developing an electrostatic latent image as claimed in claim 4, wherein the silica having the water content of less than 1% has a volume resistivity of $1\times10^{16}$ Ωcm or more.

7. The toner for developing an electrostatic latent image as claimed in claim 4, wherein a ratio A:B of silica formed by a sol-gel method (A) whose surface is treated to be hydrophobic and which has an average primary particle size of 80 to 300 nm, a water content of 3 to 15% and a volume resistivity of $1\times10^{13}$ Ωcm or more to silica (B) having a water content of less than 1% is 1:2 to 2:1.

8. The toner for developing an electrostatic latent image as claimed in claim 1, wherein the external additive further contains titanium oxide fine particles having an average primary particle size of 10 to 50 nm.

9. The toner for developing an electrostatic latent image as claimed in claim 1, wherein the toner particle has an average shape index SF of 100 to 135 represented by the following formula:

$$SF=100\times\pi ML^2/4A$$

wherein ML is an absolute maximum length of the toner particle, and A is a project area of the toner particle.

10. An electrostatic latent image developer comprising a carrier and a toner, the toner being the toner as claimed in claim 1.

11. An image forming method comprising the steps of:

uniformly charging a surface of an electrostatic latent image bearing member;

exposing the surface of the electrostatic latent image bearing member to form an electrostatic latent image;

developing the electrostatic latent image on the surface of the electrostatic latent image bearing member using a developer layer containing a toner formed on a surface of a developer bearing member to obtain a toner image;

transferring the toner image onto a transfer member; and fixing the toner image on the transfer member, the toner being the toner as claimed in claim 1.

12. The image forming method as claimed in claim 11, wherein the transfer step includes a first transfer step of primarily transferring the toner image formed on the electrostatic latent image bearing member on an intermediate transfer member and a second transfer step of secondarily transferring the toner image on the intermediate transfer member on the transfer member.

13. The image forming method as claimed in claim 12, wherein the external additive of the toner for developing an electrostatic latent image further contains a silica having a water content of less than 1%.

14. An image forming apparatus comprising:

a charging unit that uniformly charges a surface of an electrostatic latent image bearing member;

an exposure unit that exposes the surface of the electrostatic latent image bearing member to form an electrostatic latent image;

a developing unit that develops the electrostatic latent image on the surface of the electrostatic latent image bearing member using a developer layer including a toner formed on a surface of a developer bearing member to obtain a toner image;

a transfer unit that transfers the toner image onto a transfer member; and a fixing unit that fixes the toner image on the transfer member, the toner being the toner as claimed in claim 1.

15. The image forming apparatus as claimed in claim 14, wherein the transfer unit has a first transfer unit that primarily transfers the toner image formed on the electrostatic latent image bearing member on an intermediate transfer member and a secondary transfer unit that secondarily transfers the toner image on the intermediate transfer member on the transfer member.

16. The image forming apparatus as claimed in claim 14, wherein the external additive of the toner for developing an electrostatic latent image further contains silica having a water content of less than 1%.

* * * * *